US007223080B2

(12) United States Patent
Duron

(10) Patent No.: US 7,223,080 B2
(45) Date of Patent: May 29, 2007

(54) DOUBLE-ACTING, HIGH PRESSURE CRYOGENIC PUMP

(76) Inventor: Paul P. Duron, 4633 Camden Dr., Corona Del Mar, CA (US) 92625

( * ) Notice: Subject to any disclaimer, the term of this patent is extended or adjusted under 35 U.S.C. 154(b) by 409 days.

(21) Appl. No.: 10/764,139

(22) Filed: Jan. 22, 2004

(65) Prior Publication Data

US 2005/0163642 A1 Jul. 28, 2005

(51) Int. Cl.
*F04B 23/04* (2006.01)
*F17C 13/00* (2006.01)

(52) U.S. Cl. ..... 417/53; 417/534; 417/901; 62/50.6

(58) Field of Classification Search ..... 417/521, 417/534, 901, 53; 62/50.6
See application file for complete search history.

(56) References Cited

U.S. PATENT DOCUMENTS 3,181,473 A 5/1965 Duron ..... 417/435
3,456,595 A 7/1969 Gottzmann ..... 417/493
4,376,377 A * 3/1983 Duron et al. ..... 62/55.5
4,559,786 A * 12/1985 Schuck ..... 62/50.6
4,639,197 A * 1/1987 Tornare et al. ..... 417/259
5,411,374 A 5/1995 Gram ..... 417/53
5,477,690 A * 12/1995 Gram ..... 62/45.1
2002/0085921 A1 * 7/2002 Gram et al. ..... 417/53

* cited by examiner

*Primary Examiner*—Charles G. Freay

(57) ABSTRACT

A double-acting, reciprocating piston, high discharge pressure, cryogenic fluid pump having a unique blow-by venting system. In two different embodiments, a double-acting piston has two pair of piston heads and two sets of seals. In a first embodiment, a blow-by vent system is provided by a passageway that communicate with the cylinder between the pair of piston heads and vents the vapor or fluids axially through the piston rod. A second embodiment has the two piston heads separated on the piston rod a distance equal approximately to the stroke of the piston. This provides an annulus around the piston rod forming a manifold in communication with passageways through the pump cylinder wall to vent blow-by vapors or fluids. In both cases, blow-by vapors or fluids that leak or creep past the piston heads are vented to the liquid being pumped inside an insulating enclosure surrounding the pumps.

4 Claims, 3 Drawing Sheets

DOUBLE-ACTING, HIGH PRESSURE CRYOGENIC PUMP

BACKGROUND OF THE INVENTION

1. Field of the Invention

This invention relates to high pressure cryogenic pumps and more particularly relates to a double-acting, reciprocating piston, high pressure (about 2,000 psi and greater) cryogenic fluid pump that provides venting of blow-by vapors between two sets of high pressure seals on a double-acting piston.

2. Background Information

The generation and accumulation of fluid vapors from blow-by leakage in high pressure cryogenic pumps is a significant problem unless the vapors are collected and condensed in cold low pressure liquid. This invention is directed to a method and apparatus for collecting, mixing, and condensing blow-by leakage vapors with cold suction liquid.

One type of double-acting, reciprocating, piston cryogenic fluid pumps is disclosed and described in U.S. Pat. No. 5,411,374 of A. Gram issued May 2, 1995. This patent describes a double-acting, reciprocating piston, cryogenic fluid pump mechanically coupled to a double-acting hydraulic piston motor. The double-acting, reciprocating piston, cryogenic fluid pump shown in the figures and described in the text does not contain any reference to a dual set of piston seals nor does it describe a venting provision relative to the seals. Another U.S. Pat. No. 3,456,595 of C. F. Gottzmann issued Jul. 22, 1969 discloses a double-acting, reciprocating, piston pump for low pressure pumping and metering cryogenic fluids. FIG. 2 of this patent shows a double-action pumping cylinder having venting ports 28 in the working chamber. The venting system disclosed and described herein is to vent-off vapors formed during the suction stroke. The problem of venting "blow-by vapors" is not present in a low pressure pump. Another U.S. Pat. No. 3,181,473 of Duron, the inventor of the invention disclosed herein, issued May 4, 1965 and incorporated herein by reference describes improvements to a single-acting, reciprocating piston, high pressure, cryogenic fluid pump. A design feature disclosed and described in this patent traps and returns blow-by vapors to a cryogenic storage tank.

None of these patents teach or suggest an effective method for venting of blow-by vapors in double-acting pump. It would therefore be advantageous if a method could be conceived to handle this particular problem.

It is therefore one object of the invention to provide a sealing system as well as a venting system for a double-acting, high pressure reciprocating piston pump for pumping cryogenic fluids.

Another object of the present invention is to disclose a double-acting, high pressure reciprocating piston pump for cryogenic fluids that has a significantly reduced peak torque when compared with conventional single-acting pump of similar capacity and pressure rise.

Yet another object of the present invention is to provide a double-acting reciprocating piston pump that has smoother suction and discharge flows and less heat leak into the cryogenic fluid when compared with single-acting, reciprocating piston pump of similar capacity and pressure rise.

Still another object of the present invention is to disclose a double-acting, reciprocating piston, cryogenic fluid pump having a significantly improved suction performance due to the smoother inlet suction flow and less heat leak into the cryogenic fluid when compared with a single-acting, reciprocating piston pump of similar capacity and pressure rise.

Yet another object of the present invention is to disclose a multi-cylinder, double-acting, reciprocating piston, cryogenic fluid pump with improved venting of blow-by vapors.

BRIEF DESCRIPTION OF THE INVENTION

The invention disclosed and described herein relates to the sealing system and accompanying blow-by venting system for double-acting, reciprocating piston, high pressure, cryogenic fluid pumps. Experience with single-acting reciprocating, high pressure, cryogenic fluid pumps has demonstrated a need to vent and recover blow-by vapors. Double-acting, high pressure, reciprocating piston cryogenic fluid pumps need a system for venting and recovering blow-by vapors also.

The double-acting reciprocating piston pump of the present invention disclosed herein has a unique combination equivalent to two in-line single-acting piston pumps each with a separate set of high pressure seals and a common venting system.

In one embodiment of the invention, the double-acting pump has a piston with two piston heads and two sets of seals on either side of a venting system. A venting passageway between the two sets of seals vents blow-by through a passageway that exits through the top of the piston rod or shaft. Thus as the piston reciprocates blow-by vapors are vented through the passageways in the piston head out through the central passageway in the piston shaft back to the source.

In a second embodiment of the invention, a pair of piston heads are formed on a piston shaft having spaced apart separate seals. The diameter of the piston shaft between the two piston heads is such that a manifold or passageway is formed for venting blow-by vapors. The blow-by vapors exit through passageways on either side of the pump cylinder housing. As the piston reciprocates, blow-by vapors are vented out through the passageways in the pump housing back to the source.

A double-acting, reciprocating piston, high pressure, cryogenic fluid pump has significant inherent advantages over conventional single-acting, reciprocating piston, high pressure, cryogenic fluid pumps. These advantages stem from the fact that each stroke of the double-acting piston is a pumping stroke. Thus there are two output strokes per turn of the crankshaft. Whereas a conventional, single-acting, single cylinder, cryogenic fluid pump has only a single output stroke per turn of its crankshaft. The suction inflow and discharge outflow of double-acting pumps are therefore nearly continuous. The suction inflow and discharge outflow for the single-acting pump are intermittent flows each requiring about one-half a turn of its crankshaft.

Also a double-acting pump having the same capacity as a single-acting pump is significantly smaller in physical size. This feature is very important for cryogenic fluid pumps because less liquid and less cool down time are required for system cool down, i.e., preparation for system startup. The nearly continuous flows to and from the double-acting pump allows a reduction in diameter of the suction and discharge piping. This factor may reduce heat leak into the cryogenic liquid. The smoother and reduced maximum rate of inflow to the double-acting pump reduces suction pipe fluid pressure drop due to decreased acceleration of the cryogenic fluid. Hence, decreased net positive suction pressure required for pump operation. The improved suction performance can eliminate the requirement for a boost pump and associated piping.

The peak torque required for double-acting pump operation is also about one-half that of a comparable output single-acting pump. Thus, the selection of the size of the drive motor and motor starting gear is correspondingly reduced. It should be noted that the inertia torque in high pressure pumping units is very small compared with the torque required for pumping.

Another advantage is that increased capacity can be obtained by using multi-cylinder, double-acting, reciprocating piston, cryogenic fluid pumps. By this it is meant that multiple, double-acting, reciprocating piston, cryogenic fluid pumps can be operated in parallel to increase capacity.

Summarizing, a double-acting, reciprocating piston, cryogenic fluid pump is essentially two, single-acting pumps cleverly packaged into a single cylinder machine. Although the following detailed description may contain many specifics, these should not be construed as limiting the scope of the invention but merely providing illustrations of the presently preferred embodiments of the invention.

The above and other objects, advantages, and novel features of the invention will be more fully understood from the following detailed description and the accompanying drawings, in which:

DETAILED DESCRIPTION OF THE INVENTION

There are two embodiments of the double-acting, high pressure, cryogenic pump disclosed. In one embodiment, blow-by is vented through the piston rod while in the second embodiment, blow-by is vented through the pump cylinder housing.

Figure 1:
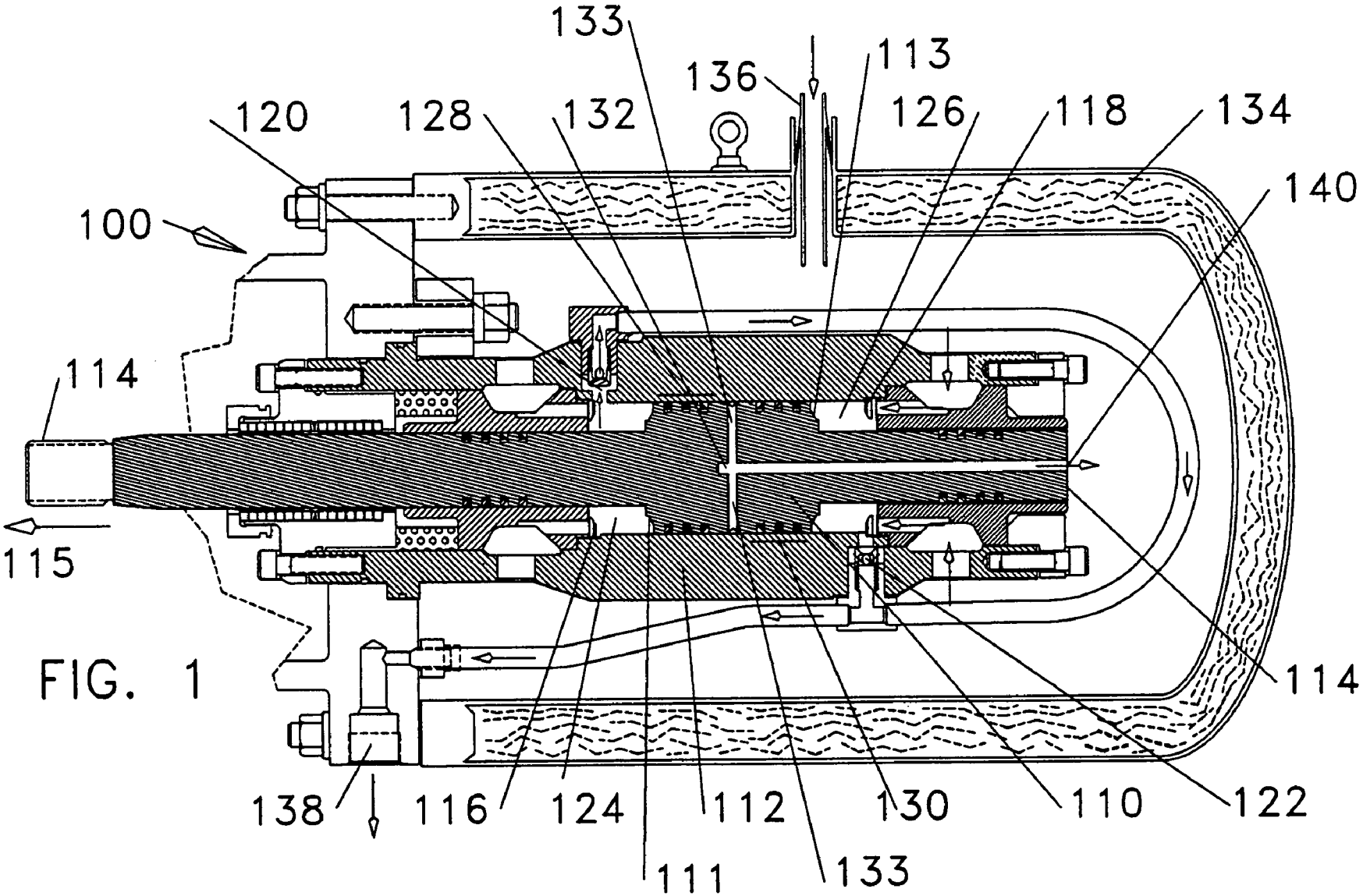
FIG. 1 is a sectional view of a double-acting, high pressure, cryogenic pump according to the invention.

Referring to FIG. 1, a cross sectional view of a double-acting, high pressure, cryogenic pump cold end 100 is illustrated. Double-acting piston 110 reciprocates in cylinder 112. The drive system or mechanism that causes piston 110 to reciprocate (not shown) is connected to piston rod 114 as is well known in the art. This mechanism normally consist of a crankshaft, a connecting rod, and a crosshead with pin. Double-acting piston 110 is shown at about mid-stroke and moving toward the left as indicated by arrow 115 at the end of piston rod 114.

Double-acting, high pressure, cryogenic pump 100 has a left side pump chamber 124 and a right side pump chamber 126. Left side pump chamber 124 as illustrated is at discharge pressure and cryogenic fluid is being discharged via open discharge valve 120. Pump fluid discharges from cold end 100 via discharge port 138. At this time, right side pump chamber 126 is increasing in volume. Fluid is flowing into chamber 126 by suction via open suction valve 118. Suction fluid is supplied from a storage tank (not shown) through suction pipe 136.

A unique feature of the invention is double-acting piston 110 includes a pair of seals 128 adjacent left pump chamber 124 and 130 adjacent right pump chamber 126 on spaced apart piston heads 111 and 113. Blow-by fluid that leaks past either of seals 128 and 130 flows axially and circumferentially along cylinder 112 through passageways 133 and 132 axially out of port 140 at the end of piston rod 114. Thus, blow-by vapors and fluids exiting from port 140 mix and condense in source liquid inside insulated enclosure 134.

The operation of the double-acting, high pressure, cryogenic pump 100 of FIG. 1 is similar to the operation of conventional single-acting, high pressure, cryogenic pumps that are in successful application worldwide. One such single-acting, high pressure pump is disclosed and described in U.S. Pat. No. 3,181,473 issued May 4, 1965 to the same inventor as the invention herein and is incorporated by reference. The major difference is that double-acting piston 110 is split into a pair of piston heads 111 and 113 and has two sets of high pressure seals 128 and 130 and a blow-by venting system comprised of an axial passageway 132 and a second passageway 133 perpendicular to the axis of piston rod 114 communicating with the cylinder between seals 128 and 130 venting blow-by vapors and fluids through port 140. Thus blow-by vapors and fluids exiting port 140 are recovered and mix and condense with the flow of suction fluid inside insulating enclosure 134 hence the condensed blow-by vapors cannot interfere with the normal operation of high pressure cryogenic pump.

Figure 2:
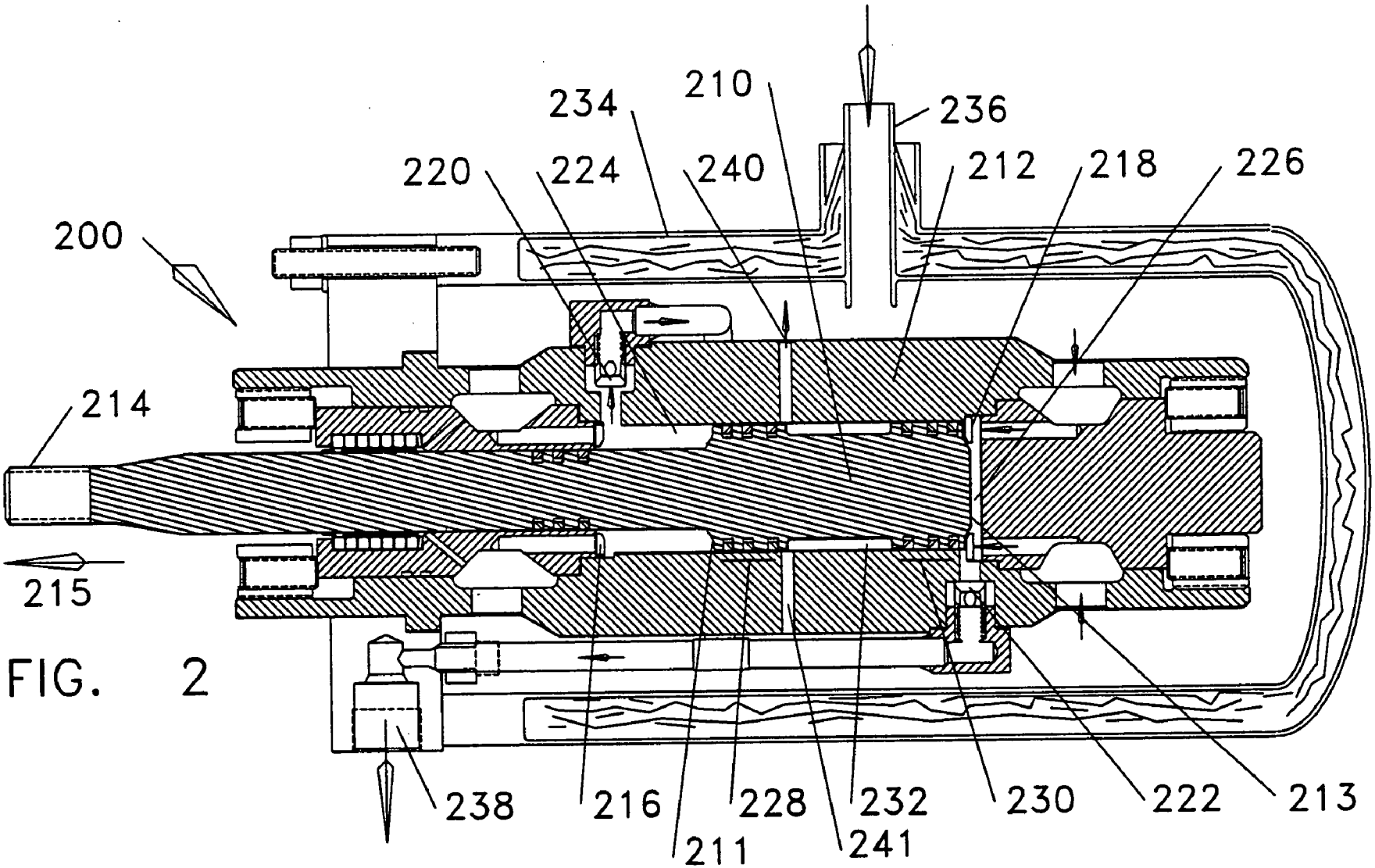
FIG. 2 is a sectional view of an alternate embodiment of a double-acting, high pressure, cryogenic pump according to the invention.

An optional second embodiment of the double-acting, high pressure cryogenic pump is illustrated in FIG. 2. In this embodiment, double-acting, high pressure, cryogenic pump cold end 200 illustrated in cross section has a double-acting piston rod 214 having a double-acting piston 210 that reciprocates in cylinder 212. As before, the mechanism, that causes piston 210 to reciprocate (not shown), is connected to piston rod 214. The mechanism for reciprocating piston rod 214 consists of a crankshaft, a connecting rod, and a cross head with a pin well known in the art. As illustrated in FIG. 2, double-acting piston is comprised of a pair of separated piston heads 211 and 213 forming an annulus or passageway 232 between the piston heads that are approximately equal to the length of the stroke of piston rod 214.

Double-acting piston 210 as illustrated in FIG. 2 is at the right or upward end of its stroke and moving toward the left as indicated by arrow 215. As illustrated, left side pump chamber 224 is at discharge pressure and cryogenic fluid is discharging via open discharge valve 220. Pump fluid discharges from cryogenic pump cold end 200 via discharge port 238. At this time, right side pump chamber 226 is increasing in volume. Cryogenic fluid is flowing into chamber 226 by suction via open suction valve 218. Fluid is supplied by suction from the storage tank (not shown) through suction pipe 236. As described previously, double-acting piston 210 has split piston heads 211 and 213 and two sets of seals, 228 at the left end and 230 at the right end each shown with three seals. Piston head 211 is annular and piston head 213 is butt ended.

A venting system for venting cryogenic fluid or vapors that creep or leak past seals 228 and 230 in piston heads 211 and 213 communicates with manifold or passageway 232 around piston rod 214. Blow-by fluid and vapor that leaks past seals 228 and 230 flows into manifold 232 around piston rod 214 and is vented through passageways 240 and 241 on opposite sides of cylinder housing 212. These exiting blow-by vapors and fluids mix and condense in suction source liquid inside insulated housing 234.

The operation of the double-acting, high pressure, cryogenic fluid pump 200 of FIG. 2 is similar to the operation of conventional single-acting, high pressure, cryogenic fluid pumps that are in operation world wide. The major difference is that double-acting piston 210 has two conventional sets of piston heads and conventional sets of high pressure cryogenic fluid seals, 228 and 230 (shown as three seals per set) forming an annulus or manifold 232 to vent blow-by fluids out through either or both passageways 240 and 241 in cylinder housing 212. A pair of passageways 240 and 241 are shown however a single passageway would be sufficient. Blow-by vapors exit through passageways 240 and 241 and cannot interfere with the normal operation of high pressure, cryogenic fluid, piston seals 228 and 230.

Figure 3:
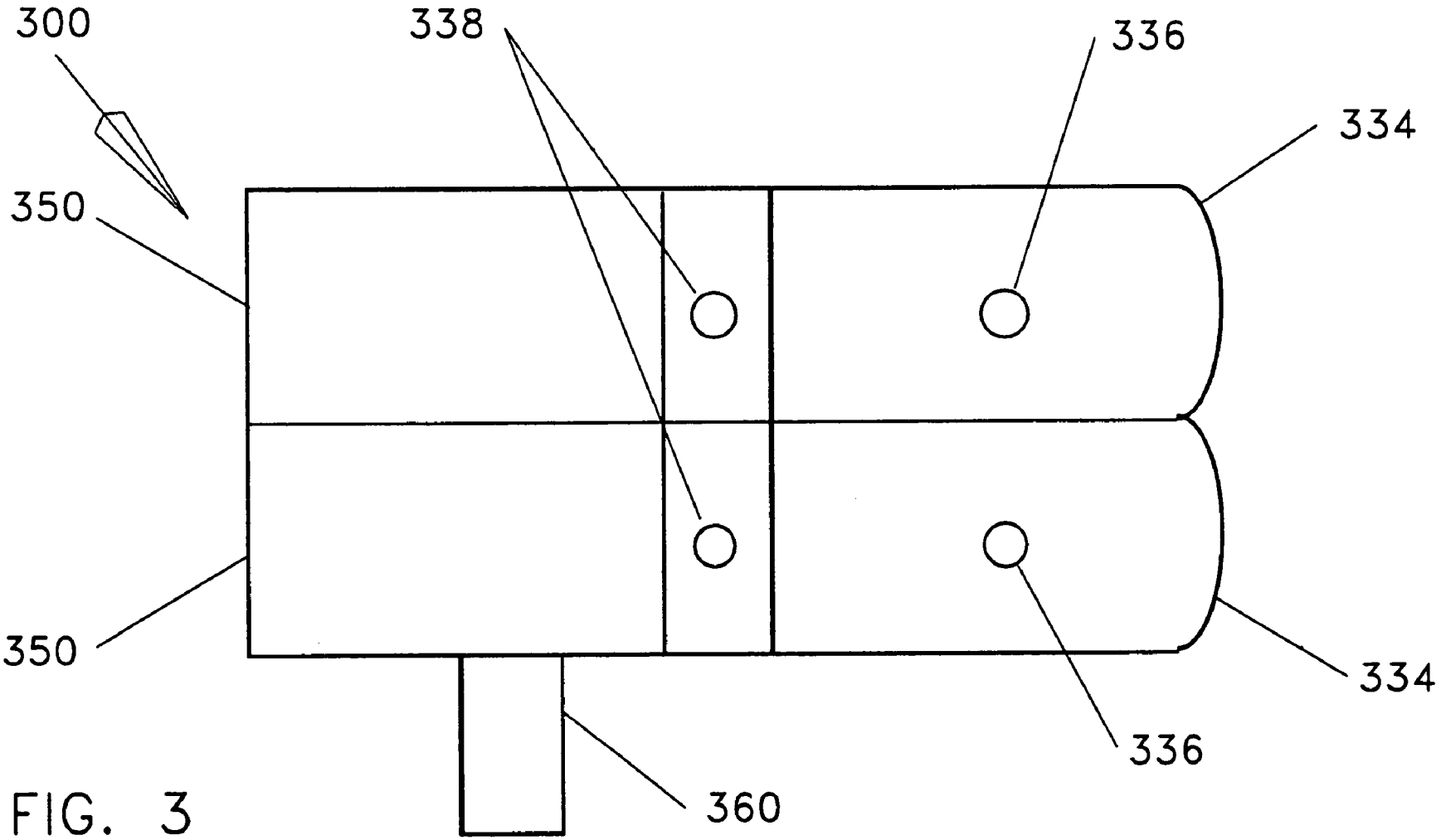
FIG. 3 is a diagram in schematic form of multiple cylinder, double-acting, high pressure, cryogenic pumps mechanically coupled to a common driver.

An application of the embodiments of either FIG. 1 and FIG. 2 is illustrated in the diagram in semi-schematic form of FIG. 3. In FIG. 3, an in-line, two cylinder, double-acting, reciprocating piston, cryogenic fluid pump 300 is comprised of a pair of cold ends 334 of multi-cylinder machine 300 that is like either of those illustrated in FIG. 1 or FIG. 2. The respective double-acting piston 114 (FIG. 1) or 214 (FIG. 2) of each cold end 334 is mechanically coupled to a driver 350. Power is input to drivers 350 via drive shaft 360. Preferably the phase relationship of drivers 350 is about 90° for a two cylinder unit and about 120° for a three cylinder machine. Suction fluid is provided through inlets 336 and high pressure fluid exits through discharge ports 338.

This invention is not to be limited by the embodiment shown in the drawings and described in the description which is given by way of example and not of limitation, but only in accordance with the scope of the appended claims.

What is claimed is:

1. A double-acting, reciprocating piston, high-pressure, cryogenic pump comprising:

a cylinder;

a piston rod;

a pair of spaced apart piston heads on said piston rod defining left side and right side pump chambers each having a suction valve communicating with a source of cryogenic suction liquid;

each of said piston heads having a set of high-pressure seals;

venting passageways for venting blow-by vapors or fluids between said piston seals;

said venting passageways including a first generally radial venting passageway between said piston heads connected to a second axial venting passageway in said piston rod;

said second axial passageway being in communication with said source of cryogenic suction liquid;

said blow-by vapors or fluids mix and condense in said suction liquid;

whereby said blow-by vapors or fluids are condensed in said suction liquid and do not interfere with normal operation of said cryogenic pump.

2. A double-acting, reciprocating piston, high pressure, cryogenic pump comprising:

a cylinder;

a piston rod;

a pair of spaced apart piston heads on said piston rod defining left side and right side pump chambers with said cylinder;

said pump chambers each having a suction valve communicating with a source of cryogenic suction liquid;

each of said piston heads having a set of high-pressure seals;

said cylinder having at least one vent hole passageway in a plane approximately mid-stroke of said piston head seals;

said vent hole passageway in said cylinder in communication with said source of suction liquid;

any blow-by vapors leaking past said high-pressure sets of seals mix and condense in said suction liquid;

whereby blow-by vapors are condensed in said suction liquid and do not interfere with normal operation of said cryogenic pump.

3. A method for pumping a cryogenic liquid with a double-acting, reciprocating piston pump from suction pressure to high-pressure comprising the steps of:

providing a cylinder with cylinder heads at opposite ends each having suction and discharge valves;

providing a piston rod with seals extending through one of said cylinder heads;

providing a pair of spaced apart piston heads on said piston rod;

providing a set of high-pressure seals on each of said piston heads which are slidable in the bore of said cylinder;

providing a low-pressure cavity between said spaced apart sets of high-pressure seals and communicating said low pressure cavity to a source of cryogenic suction liquid via a passageway;

said spaced apart piston heads defining left side an right side pump chambers in said cylinder;

providing an insulating jacket filled with said suction liquid surrounding said cylinder and said cylinder heads;

flowing said suction liquid into said right side pump chamber with increasing volume due to the direction of motion of said piston head and simultaneously discharging high-pressure liquid from said left side pump chamber; and flowing said suction liquid into said left side pump chamber during the return stroke of said piston rod and simultaneously discharging high-pressure liquid from said right side pump chamber and venting any blow-by vapors present in said low-pressure cavity to said source of cryogenic suction liquid through said passageway so that the blow-by vapors are mixed and condensed in said suction liquid.

4. A method for pumping a cryogenic liquid with a double-acting, reciprocating piston pump from suction pressure to high-pressure comprising the steps of:

providing a cylinder with cylinder heads at opposite ends each having suction and discharge valves;

providing a piston rod with seals extending through one of said cylinder heads;

providing a pair of spaced apart piston heads on said piston rod;

providing a set of high-pressure seals on each of said piston heads which are slidable in the bore of said cylinder;

providing at least one vent hole passageway in said cylinder in a plane approximately mid-stroke of said piston head seals;

providing a low-pressure cavity between said spaced apart sets of high-pressure seals and communicating said low-pressure cavity to a source of cryogenic suction liquid via said vent hole passageway;

said spaced apart piston heads defining left side and right side pump chambers in said cylinder;

providing an insulating jacket filled with said cryogenic suction liquid surrounding said cylinder and said cylinder heads;

flowing said cryogenic suction liquid into said right side pump chamber with increasing volume due to the direction of motion of said piston head and simultaneously discharging high-pressure liquid from said left side pump chamber; and flowing said cryogenic suction liquid into said left side pump chamber during tho return stroke of said piston rod and simultaneously discharging high-pressure liquid from said right side pump chamber and venting any blow-by vapors present in said low-pressure cavity to said source of cryogenic suction liquid through said vent hole passageway so that the blow-by vapors are mixed and condensed in said cryogenic suction liquid.

* * * * *